United States Patent [19]

Mueller

[11] 4,373,349

[45] Feb. 15, 1983

[54] HEAT PUMP SYSTEM ADAPTIVE DEFROST CONTROL SYSTEM

[75] Inventor: Dale A. Mueller, St. Paul, Minn.

[73] Assignee: Honeywell Inc., Minneapolis, Minn.

[21] Appl. No.: 278,943

[22] Filed: Jun. 30, 1981

[51] Int. Cl.[3] ..... F25D 21/06

[52] U.S. Cl. ..... 62/156; 62/155

[58] Field of Search ..... 62/156, 155, 234, 151, 62/140, 128, 126, 160; 165/17

[56] References Cited

U.S. PATENT DOCUMENTS 4,209,994 7/1980 Mueller et al. ..... 62/155

4,328,680 5/1982 Stamp, Jr. et al. ..... 62/155

4,338,790 7/1982 Saunders et al. ..... 62/156

*Primary Examiner*—Albert J. Makay

*Assistant Examiner*—Harry Tanner

*Attorney, Agent, or Firm*—Roger W. Jensen

[57] ABSTRACT

A defrost control system for a reverse cycle refrigeration system wherein the outdoor coil is defrosted when outdoor coil temperature is equal to or less than the product of a preselected constant $N_1$ and the outdoor air temperature and controller means are provided to calculate a new value of $N_1$ after each defrost operation, the calculation being based on stabilized values of outdoor air temperature and outdoor coil temperature for clear coil conditions.

8 Claims, 3 Drawing Figures

HEAT PUMP SYSTEM ADAPTIVE DEFROST CONTROL SYSTEM

BACKGROUND OF THE INVENTION

A long-standing problem associated with the use of heat pumps in most parts of the world is that frequently the outdoor coil will, during the heating mode of operating, have frost/ice accumulate and built-up thereon. As the ice thickness increases, the overall efficiency of the heat pump system decreases significantly, and a substantial amount of energy may be wasted. Accordingly, many arrangements have been proposed heretofore for detecting the frost and/or ice and for taking corrective action for removing the frost/ice from the outdoor coil. Examples of prior art systems include the following U.S. Pat. Nos.: 3,170,304; 3,170,305; 3,400,553 and 4,2090,994.

It has been recognized that, for a given set of criteria, there is an optimum point (of frost/ice build up) at which to command a defrost mode of operation of the heat pump system. If defrost is commanded too soon or too late, energy will be wasted, i.e., total system efficiency will suffer.

The present invention is an adaptive defrost control system which is self-adaptive so that for each cycle of operation of the heat pump system, i.e., a heating operation followed by a defrost mode of operation followed by another heating cycle, etc. there will be a modification of the control apparatus so as to readjust the control point for initiating defrost.

SUMMARY OF THE INVENTION

The present invention is an outdoor coil defrost control system for a reverse cycle refrigeration system comprising the usual refrigerant compression means, indoor coil, outdoor coil, and refrigerant conduit means interconnecting the compression means and the coils. The defrost control system comprises outdoor air temperature sensing means having an output indicative of outdoor air temperature, outdoor coil temperature sensing means having an output indicative of the temperature of the outdoor coil, means for producing an output signal indicative of the operation of the compression means, enclosure temperature sensing means having an output indicative of a demand for heating or cooling of the enclosure being heated or cooled by the heat pump, and a special controller means. The controller means is effective to place the system into an outdoor coil defrost mode of operation when all of the following have occurred: (i) outdoor coil temperature is less than a preselected permit temperature, (ii) the compression means has been operating for a preselected minimum length of time, and (iii) outdoor coil temperature is then equal to or less than the product of a constant $N_1$ times the outdoor air temperature, $N_1$ being initially a preselected initial multiplier; thereafter the controller being effective to place the system into a non-defrost mode of operation when certain defrost terminate conditions have occurred; and thereafter said controller being effective after each defrost operation to calculate a new value of $N_1$ based on stabilized values of the outdoor coil temperature and the outdoor air temperature for clear coil conditions.

The present invention maintains the initiation of outdoor coil defrost at the optimum point so as to save energy, i.e., increase system efficiency and lower total cost of heating the enclosure.

DESCRIPTION OF THE PREFERRED EMBODIMENT

Figure 1:
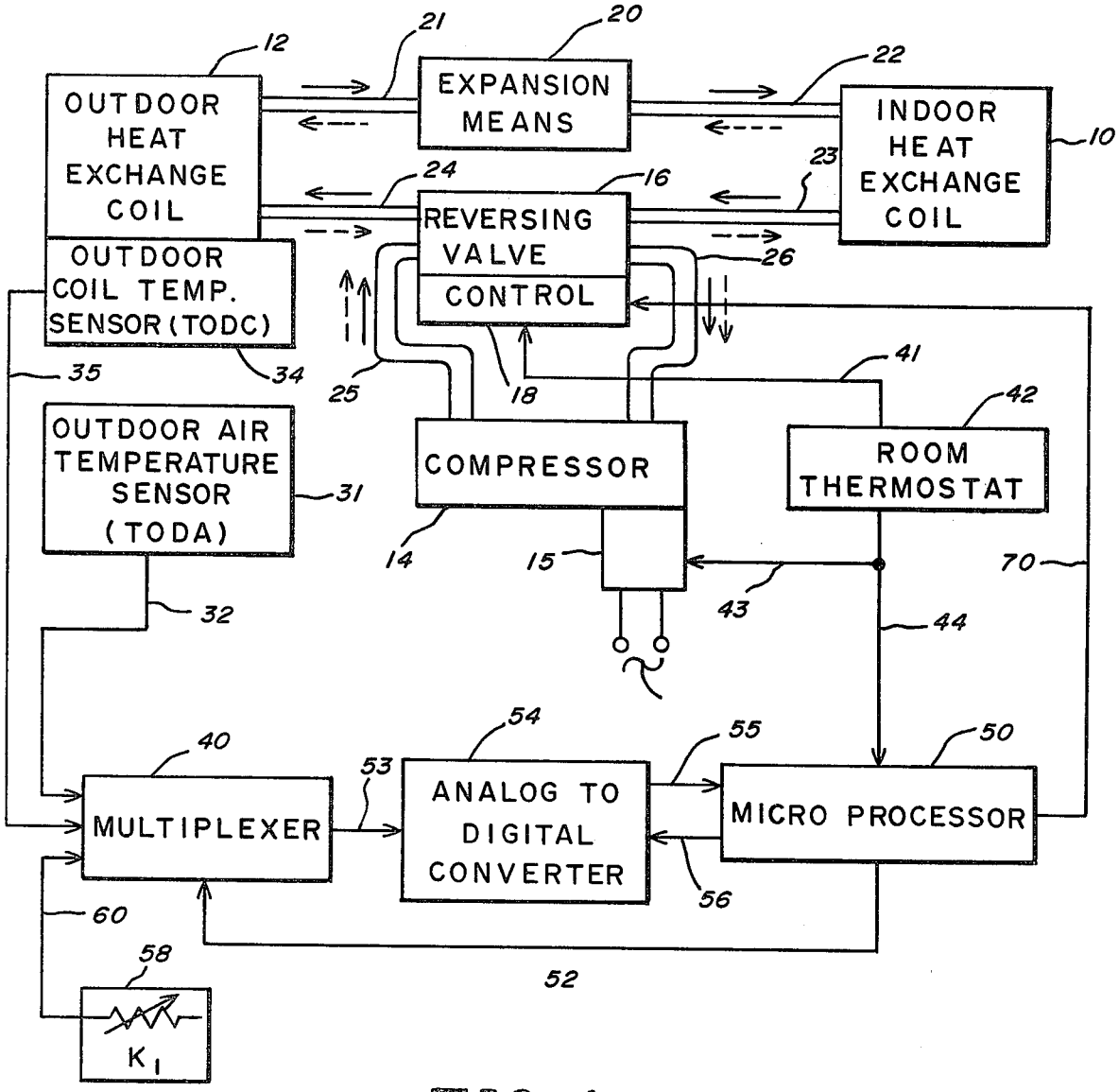
FIG. 1 is a block diagram of a reverse cycle refrigeration system utilizing the present invention.

Referring to the FIG. 1 block diagram of the reverse cycle refrigeration system, including the outdoor coil defrost control system thereof, the refrigeration system comprises an indoor heat exchange coil 10, an outdoor heat exchange coil 12, a refrigerant compression means or compressor 14 and refrigerant conduit means interconnecting the coils and the compressor, the refrigerant conduit means including a reversing valve 16 having a control 18, an expansion means 20, and appropriate piping 21–26. The system as thus far described is old in the art and is exemplified by the above identified patents; e.g., U.S. Pat. Nos. 3,170,304. Briefly, during the indoor heating mode, i.e., when the reverse cycle system is operating to heat the inside of a building, compressor 14 will discharge relatively hot gaseous refrigerant through pipe 25, reversing valve 16 and pipe 23 to the indoor heat exchange coil 10. During the cooling or defrost mode, the reversing valve 16 is operated so that the hot gaseous refrigerant from the compressor is routed via pipe 25, reversing valve 16 and pipe 24 to the outdoor heat exchange coil 12.

The defrost control system comprises an outdoor air temperature sensing means 31 which will hereinafter sometimes be referred to as "TODAS". Outdoor air temperature sensing means 31 has an output 32 on which is available an output signal "TODA" indicative of the outdoor air temperature. Output 32 is one of three inputs to a multiplexer 40 to be described in more detail below. The defrost control system further comprises outdoor coil temperature sensing means which hereinafter may be referred to as "TODCS" identified in FIG. 1 by the reference numeral 34 having an output lead 35 on which is available an output signal "TODC" indicative of the temperature of the outdoor coil, lead 35 being connected to multiplexer 40 as a second input thereof.

Compressor 14 is controlled by a controller 15 adapted to be energized from a suitable supply of electric power 17 and to be controlled from a rest or "off" position to an operating or "on" condition as a function of either "heating" or "cooling" control signals applied to controller 15 from a suitable room thermostat 42 through interconnection means 43. The reversing valve 16 is also controlled via a connection 41 by the room thermostat 42 to be in the appropriate position for the commanded system mode of operation; i.e., heating or cooling. The output from the room thermostat 42 is also applied through a connection 44 as a first input to a microprocessor 50.

The third input to multiplexer 40 is from a source 58 of a constant signal $K_1$ determined to be the slope of the initial defrost initiate relationship, the source 58 being depicted to comprise a variable resistance 59 connected by a lead 60 to the multiplexer 40. The apparatus of block 58 and/or its function could also be considered to be included within the microprocessor 50.

A connection 52 linking the miroprocessor 50 and the multiplexer 40 enables the microprocessor to control the multiplexer in a manner well known to those skilled in the art so that appearing at the output 53 of the multiplexer will be either a TODA signal indicative of outdoor air temperature as sensed by TODAS 31, an outdoor coil temperature TOCD as sensed by TODCS 34, or the $K_1$ signal from 58. The output 53 of the multiplexer 40 is applied as an input to an analog-to-digital converter 54 which has an output 55 applied to the microprocessor 50 and which receives through connection 56 an input from the microprocessor 50. Analog to digital converter 54 functions to convert the analog temperature signals appearing at input 53 thereof into a digital form for utilization by the microprocessor 50.

The microprocessor 50 has an output connection 70 which is applied to control 18 of reversing valve 16, which in turn controls the mode of operation of the reverse cycle refrigeration system; i.e., either heating or cooling, it being understood that the cooling mode will cause the melting and dispersal of any frost on the outdoor coil which had accumulated during the prior heating mode of operation.

A suitable microprocessor that may be used as a component in the system comprising the present invention is the Intel Corporation Model 8049. Further, an appropriate analog-to-digital converter for use as item 54 is Texas Instruments Inc. Model TL505C (see T.I. Bulletin DL-5 12580); and an appropriate multiplexer is the Motorola Inc. Model MC14051BP. Further, Honeywell Inc., platinum film resistance type temperature sensors Models C800-A and C800-B may be used for TODAS 31 and TODCS 34 respectively; and Honeywell Inc. Model T872 thermostat may be used for room thermostat 42, the Model T872 being a bimetal operated mercury switch for heating-cooling and including switch means for controlling a plurality of auxiliary heating means. Further, an appropriate heat pump; i.e., components 10, 12, 14, 15, 16, is the Westinghouse Company HI-RE-LI unit comprising outdoor unit Model No. HL036COW and indoor unit AG012HOK.

It will be understood by those skilled in the art that the functional interconnection depicted in FIG. 1 are representative of one or more electrical wires or pipes, as the case may be, as indicated by the specific equipment used. It will also be understood that the room thermostat means 42 may be referred to as a means which is operatively associated with the compressor 14 and adapted to have an output indicative of the operation of the compressor because operation of the thermostat causes operation of compressor 14 from an "off" to an "on" or operating condition; connection 44 from thermostat 42 to microprocessor 50 thus constitutes an input indicative of compressor operation.

Figure 2:
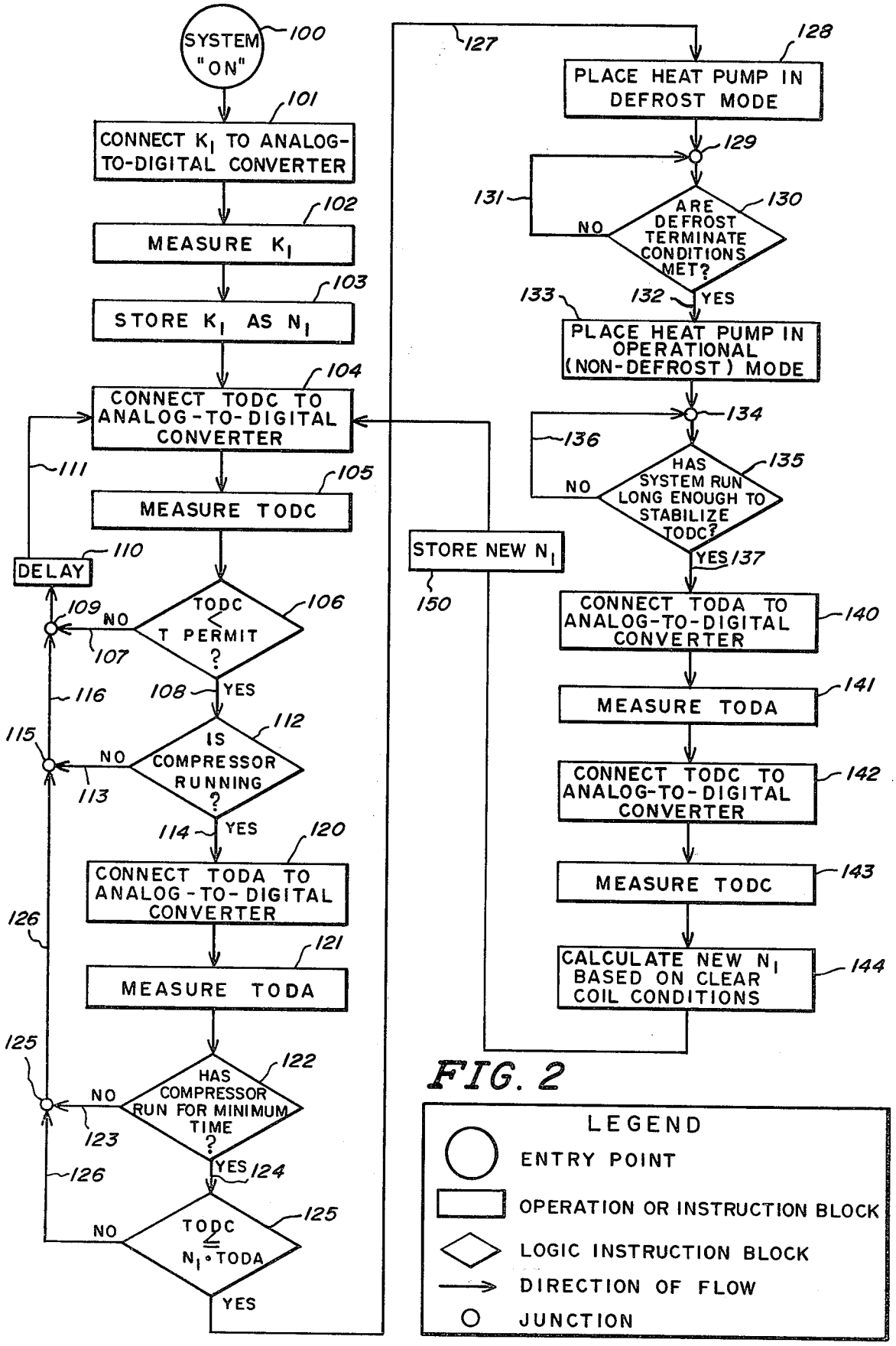
FIG. 2 is a flow diagram for the control of the microprocessor depicted as one of the elements of the system of FIG. 1.

FIG. 2 depicts the flow chart for the control of the apparatus shown in FIG. 1. In FIG. 2 the reference numeral 100 identifies an entry point SYSTEM "on", the flow from which is to an instruction block 101 "CONNECT $K_1$ to ANALOG-TO-DIGITAL CONVERTER" which flows to an instruction block 102 "MEASURE $K_1$" which flows to an instruction block 103 "STORE $K_1$ as $N_1$" which flows to an instruction block 104 "CONNECT TODC TO ANALOG-TO-DIGITAL CONVERTER" the flow from which is to an instruction block 105 "MEASURE TODC," the flow from which is to a logic instruction block 106, "TODC IS LESS THAN $T_{PERMIT}$?" having a "no" response 107 connected through a junction 109 to a delay means 110 and thence via connection means 111 back to instruction block 104. Logic instruction block 106 has a "yes" response 108 which flows to a logic instruction block 112 "IS COMPRESSOR RUNNING?" having a "no" response 113 connected to a junction 115 and a connection means 116 to junction 109. Logic instruction block 112 has a "yes" response 114 which flows to an instruction block 120 "CONNECT TODA TO ANALOG-TO-DIGITAL CONVERTER," the flow from which is to an instruction block 121 "MEASURE TODA," the flow from which is to a logic instruction block 122 "HAS COMPRESSOR RUN FOR MINIMUM TIME?" having a "no" response 123 connected to a junction 125 and thence through a connection 126 to junction 115. Logic instruction block 122 also has a "yes" response 124 which flows to a logic instruction block 125 "TODC IS EQUAL TO OR LESS THAN $N_1$ TIMES TODA?" having a "no" response 126 connected to junction 125 and a "yes" response 127 which flows to an instruction block 128 "PLACE HEAT PUMP IN DEFROST MODE" the flow from which is to a junction 129 and thence to a logic instruction block 130 "ARE DEFROST TERMINATE CONDITIONS MET?" having a "no" response 131 which is connected back to junction 129 and a "yes" response 132 which flows to an instruction block 133 "PLACE HEAT PUMP IN OPERATIONAL (NON-DEFROST)MODE" the flow from which is to a junction 134 and thence to a logic instruction block 135 "HAS SYSTEM RUN LONG ENOUGH TO STABILIZE TODC?" having a "no" response 136 which flows back to the junction 134 and a "yes" response 137 which flows to an instruction block 140 "CONNECT TODA TO ANALOG-TO-DIGITAL CONVERTER" the flow from which is to an instruction block 141 "MEASURE TODA" the flow from which is to an instruction block 142 "CONNECT TODC TO ANALOG-TO-DIGITAL CONVERTER" the flow from which is to an instruction block 143 "MEASURE TODC" the flow from which is to an instruction block 144 "CALCULATE NEW $N_1$ BASED ON CLEAR COIL CONDITIONS" the flow from which is to an instruction block 150 "STORE NEW $N_1$" the flow from which is back to instruction block 104.

DESCRIPTION OF OPERATION

In practice, the value of $K_1$ within device 58 of FIG. 1 would be set at some average value at the factory before shipment to the installation site. To understand the system operation, the apparatus shown in FIG. 1 can be visualized to be installed and operational with the TODA and the TODC signals being transmitted to the multiplexer 40 (together with the $K_1$ signal from device 58, all of which are selectively converted into digital form by the analog-to-digital converter 54 and thereafter applied via 55 to microprocessor 50. Assuming that the heat pump is being used in the heating mode and assuming further that the outdoor conditions of temperature and humidity are such so that frost and/or ice would slowly build up on the outdoor heat exchange coil 12, it will be understood that a situation exists which will eventually require the defrosting of the outdoor coil. Referring to FIG. 2, it is seen that the system measures the value of K at 102 which is then stored as $N_1$ at 103. The value of TODC is measured and compared at 106 with a preselected value of $T_{PERMIT}$. If TODC is greater than the value of $T_{PERMIT}$, this means for instance with a $T_{PERMIT}$ of 32F, the outdoor coil is not capable of forming frost and/or ice and accordingly the "no" response at 107 causes a recycling of the above described functions. However, if TODC is less than or lower than the value of $T_{PERMIT}$, then this is a signal that means the outdoor coil temperature is such that there may be an icing problem and that further matters have to be checked out. Thus, the flow from 106 is to a logic instruction block 112 which determines whether or not the compressor is running for defrosting can only occur if the compressor is running and if the answer to that question is "yes" then the instruction blocks 120 and 121 result in the measurement of the outdoor air temperature TODA which flows to the logic instruction block 122 to ascertain whether or not the compressor has run for a minimum length of time that would be required for stable values of air and coil temperature such as 5 to 10 minutes. Next a logic instruction block 125 a comparison is made between TODC and the product of $N_1$ and TODA. If TODC is less than or equal to such product frost and/or ice are present, then the "yes" response at 127 flows to 128 and results in the heat pump system being shifted to the defrost mode of operation. In FIG. 1 this would be accomplished by the output from microprocessor 50 being applied via 70 to the control 18 of the reversing valve 16 so as to shift the system into the defrost mode of operation which causes heated or hot refrigerant to be transmitted from the compressor 14 via conduit 25, reversing valve 16 and conduit 24 to flow through the outdoor coil 12 and thereby melt off accumulated frost and ice.

It is important to terminate the defrost mode of operation as soon as the frost and ice have been melted from the outdoor coil; in FIG. 2 this is accomplished by the logic instruction block 130 which checks to determine whether or not the defrost terminate conditions have been met. Such defrost terminate conditions might be (i) whether TODC is greater than or equal to a preselected terminate temperature such as 55 F., or (ii) whether the system has been in the defrost mode of operation for ten minutes or more of compressor running time. If the defrost terminate conditions are met, then the "yes" response at 132 is effective to place the heat pump in the operational or non-defrost mode of operation. Next the system considers whether or not the system has run long enough so as to stabilize the temperature TODC, this typically would be a short interval of time, say five minutes. A "yes" response from 135 then would flow at 137 sequentially to instruction blocks 140, 141 and 142 and 143 and 144 for the purpose of calculating a new value of $N_1$ based on clear coil conditions. The new value of $N_1$ is stored as at 150 to be used at logic instruction block 125 for the control of initiating the placement of the heat pump system into the defrost mode of operation for the next need for defrost.

Figure 3:
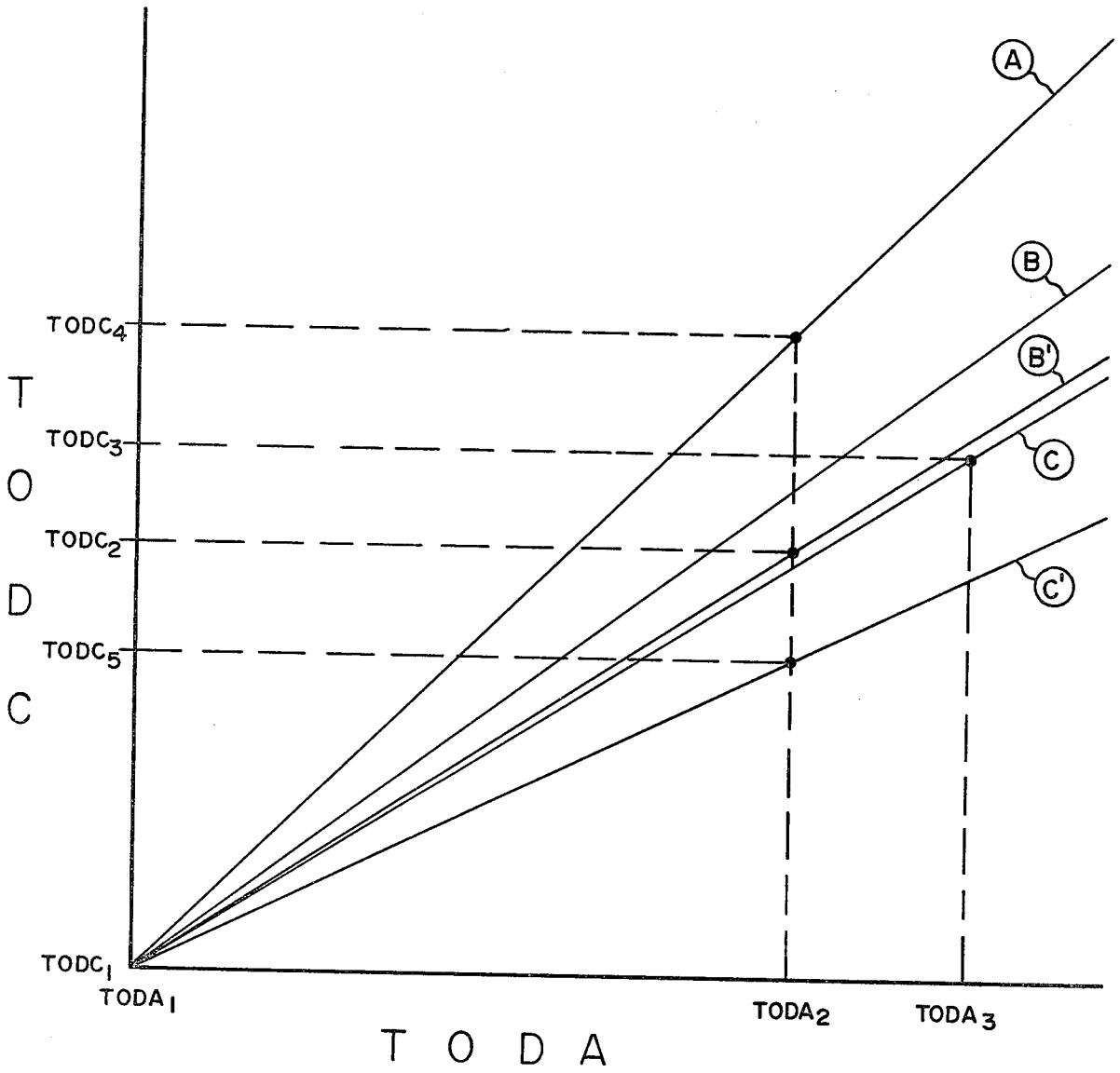
FIG. 3 is a graph showing certain relationships between outdoor air temperature, outdoor coil temperature and certain defrost control relationships.

Referring to FIG. 3, it will be noted that TODC is plotted on the vertical axis and TODA is plotted on the horizontal axis and that five relationships A, B, C, B' and C' are depicted. Relationship A shows TODC is equal to TODA which occurs when the heat pump is at an "off" state. In order for the outdoor coil to transfer energy from outdoor ambient into the refrigerant during the heating mode, the outdoor coil must be colder than outdoor ambient as shown by relationship B. The convergence of relationships A and B at $TODC_1$ and $TODA_1$ is well known to be caused primarily by refrigerant evaporating properties, the expansion device, and the compressor.

It is also well known that for optimum defrost energy efficiency, the difference between relationships A and B should be allowed to increase approximately 50%. This results in relationship C at which defrost initiating versus outdoor ambient is desired. This also converges with relationships A and B at $TODC_1$ and $TODA_1$. The slope of relationship C is $(TODC_3-TODC_1)/(TODA_3-TODA_1)$ which is predetermined and used as $K_1$.

Also well known is that relationship B may vary due to variations of refrigerant charge, heat pump installations, equipment design, system components (coils, compressor, expansion device, etc.), or coil air flows. For example, this could result in relationship B'. The small difference between clear coil conditions B' and the initiate control line C will now lead to excessive and energy-wasting defrosting.

For the new condition of B', the control now determines a new initiate control line C'. For instance, at an outdoor ambient of $TODA_2$, the microprocessor; has been instructed that $TODC_4$ equals $TODC_2$, determines $TODC_2$ after the system has run long enough to stabilize TODC, and has been instructed to determine the new slope $N_1$. It does this by increasing the difference of $TODA_4$ and $TODC_2$ by 50% as previously determined to be energy effective; thereby determining $TODC_5$ equals $[TODC_4-1.5\ (TODC_4-TODC_2)]$. The new N is then $(TODC_5-TODC_1)/TODC_2-TODC_1)$ which is the slope of the new initiate control line C'. Relationship C' also converges with relationships A,B, and B' at $TODC_1$ and $TODA_1$.

It is seen therefore that with this system a means is provided for adapting the defrost initiate control point on a continuous basis. Thus, for each cycle of defrost a new value of $N_1$ is computed which then is utilized at 125 for controlling the initiation of the defrost mode of operation. This is a significant benefit in heat pump control because the system permits the control precisely of adapting the defrost initiate control point corresponding to a predetermined amount of heat pump degration, thereby maintaining energy optimization of the defrost function. The advantage of this system is that by being adaptable it does adjust to various variations that can occur in a typical installation. For example, a typical heat pump system can have equipment where, the amount of refrigerant charge may change or vary. In addition, there can be capacity variations of indoor and outdoor heat exchange coils. Further, different equipment designs have different performance parameters. This system accommodates all of the above variations and sensor and control accuracies to provide an optimum initiation of the defrost function in all cases.

While I have described a preferred embodiment of the invention, it will be understood that the invention is limited only by the scope of the following claims.

I claim:

1. An outdoor coil defrost control system (hereinafter "defrost control system") for a reverse cycle refrigeration system (hereinafter "system") for heating and cooling a building wherein said system comprises refrigerant compression means, an indoor coil, an outdoor coil, and refrigerant conduit means connecting said compression means and said coils, said defrost control system comprising:

outdoor air temperature sensing means (hereinafter "TODAS") having an output indicative of outdoor air temperature (hereinafter "TODA");

outdoor coil temperature sensing means (hereinafter "TODCS") having an output indicative of the temperature of said outdoor coil (hereinafter "TODC");

enclosure temperature sensing means (hereinafter "STAT") having an output indicative of a demand for heating or cooling of the enclosure;

means (hereinafter "COM") operatively associated with said compression means and adapted to have an output indicative of the operation of said compression means; and controller means having operative connections to said TODA, TODC, STAT, and COM so as to receive the outputs thereof, said controller being effective to place said system into an outdoor coil defrost mode of operation when all of the following four events have occurred:

(a) TODC is less than $T_{PERMIT}$, where $T_{PERMIT}$ is a preselected value, (b) COM output indicates operation of said compression means, (c) COM output indicates said compression means has operated for a preselected minimum time, and (d) TODC is equal to or less than $N_1$. TODA where $N_1$ is a preselected initial multiplier;

thereafter said controller being effective to place said system into a non-defrost mode of operation when defrost terminate conditions have occurred; and thereafter said controller being effective after each defrost operation to calculate a new value of $N_1$ based on the stabilized values of TODC and TODA for clear coil conditions whereby the defrost initiate control point is adjusted after each defrost operation.

2. Apparatus of claim 1 further characterized by said terminate condition being that instantaneous TODC is equal to or greater than a preselected terminate temperature.

3. Apparatus of claim 1 further characterized by said terminate condition being that said system has been in a defrost mode of operation for a predetermined length of time.

4. Apparatus of claim 1 further characterized by said controller including means for permitting said calculation of a new value of $N_1$ only after said system had been operating in a non-defrost mode of operation for a preselected period of time.

5. An outdoor coil defrost control system (hereinafter "defrost control system") for a reverse cycle refrigeration system (hereinafter "system") for heating a building wherein said system comprises refrigerant compression means, an indoor coil, an outdoor coil, and refrigerant conduit means connecting said compression means and said coils, said defrost control system comprising:

outdoor air temperature sensing means (hereinafter "TODAS") having an output indicative of outdoor air temperature (hereinafter "TODA");

outdoor coil temperature sensing means (hereinafter "TODCS") having an output indicative of the temperature of said outdoor coil (hereinafter "TODC");

means (hereinafter "COM") operatively associated with said compression means and adapted to have an output indicative of the operation of said compression means; and controller means having operative connections to said TODA, TODC, and COM so as to receive the outputs thereof, said controller being effective to place said system into an outdoor coil defrost made of operation when all of the following events have sequentially occurred:

(a) TODC is less than $T_{PERMIT}$, where $T_{PERMIT}$ is a preselected value, (b) COM output indicates operation of said compression means and said compression means has operated for a preselected minimum time, and (c) thereafter TODC is equal to or less than $N_1$.TODA where $N_1$ is a preselected initial multiplier;

thereafter said controller being effective to place said system into a non-defrost mode of operation when defrost terminate conditions have occurred; and thereafter said controller being effective after each defrost operation to calculate a new value of $N_1$ based on the instantaneous values of TODC and TODA for clear coil conditions whereby the defrost initiate control point is adjusted after each defrost operation.

6. Apparatus of claim 5 further characterized by said terminate condition being that instantaneous TODC is equal to or greater than a preselected terminate temperature.

7. Apparatus of claim 5 further characterized by said terminate condition being that said system has been in a defrost mode of operation for a predetermined length of time.

8. Apparatus of claim 5 further characterized by said controller including means for permitting said calculation of a new value of $N_1$ only after said system had been operating in a non-defrost mode of operation for a preselected period of time.

* * * * *